United States Patent [19]

Hottmann

[11] Patent Number: 5,027,473

[45] Date of Patent: Jul. 2, 1991

[54] REFRIGERATOR DOOR CLOSER

[75] Inventor: Philip F. Hottmann, Cross Plains, Wis.

[73] Assignee: Sub-Zero Freezer Company, Inc., Madison, Wis.

[21] Appl. No.: 383,193

[22] Filed: Jul. 20, 1989

[51] Int. Cl.[5] ..... E05F 1/08

[52] U.S. Cl. ..... 16/286; 16/80

[58] Field of Search ..... 16/49, 80, 286, 291; 49/386

[56] References Cited

U.S. PATENT DOCUMENTS

| | | | |
|---|---|---|---|
| 2,189,818 | 2/1940 | Murrin | 16/291 |
| 2,392,689 | 1/1946 | Peglow | 16/80 |
| 2,758,454 | 8/1956 | Cossin | 16/286 |
| 3,392,419 | 7/1968 | Stein et al. | 16/49 |
| 3,842,542 | 10/1974 | White et al. | 49/386 |

FOREIGN PATENT DOCUMENTS

| | | | |
|---|---|---|---|
| 657388 | 1/1951 | United Kingdom | 16/80 |

*Primary Examiner*—Robert L. Spruill
*Assistant Examiner*—Carmine Cuda
*Attorney, Agent, or Firm*—Foley & Lardner

[57] ABSTRACT

A door closer assembly for a household refrigerator of the type having a door frame with a front faced surface and a door having a confronting surface, the assembly including a hinge plate mounted on the door frame and having a pivot pin mounted on the hinge plate in a spaced relation to the front faced surface, a door plate mounted on the door and having an aperture spaced from the confronting surface of the door and a pivot post spaced from the aperature, the door plate being mounted on the hinge plate with the pivot pin aligned with the aperature, and an offset arm connected to the pivot post and biased by a spring in a door closing direction.

7 Claims, 3 Drawing Sheets

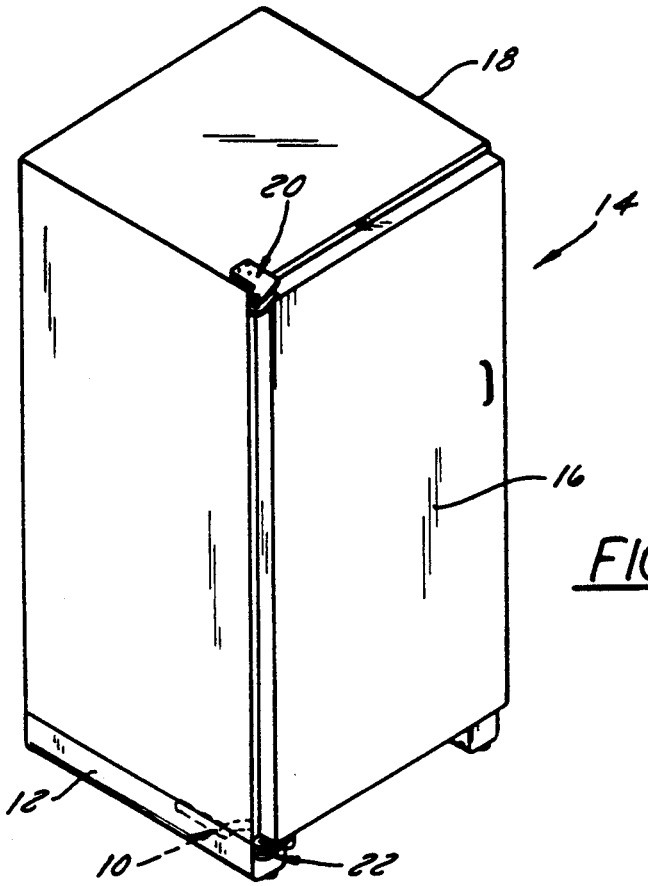
FIG. 1
FIG. 5
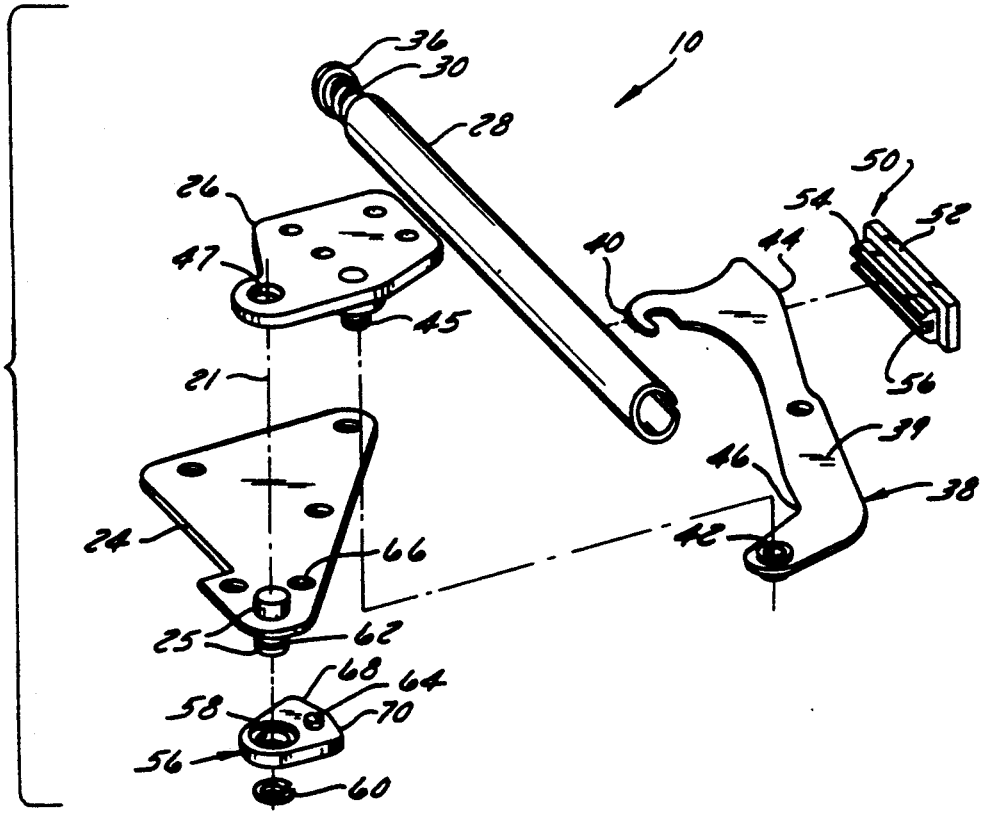

REFRIGERATOR DOOR CLOSER

BACKGROUND OF THE INVENTION

1. Field of the Invention

The present invention relates to a door closer for a refrigerator, and more particularly to a spring loaded door closer which provides a continuous bias force on the door during opening and closing of the door.

2. Description of the Prior Art

Refrigerators which are used in the home have over the years become larger in order to accommodate a greater variety of products and services. In order to provide increased space within the refrigerator, the doors are now provided with storage shelves, water and ice dispensing systems and in some instances even the electronic control systems are housed in the doors. The doors have therefore not only become heavier but wider in order to accommodate these various devices.

In the door closers presently available, the common type of system utilizes a detent type arrangement wherein the door when fully opened is locked in the open position and when released from the detent must be pushed toward the closed position before the spring system comes into play. Often times the door will be moved over the detent but not closed far enough for the spring loaded closer to fully close the door.

SUMMARY OF THE INVENTION

The present invention provides for a continuous closing action as soon as the door passes a 90 degree position with respect to the front of the refrigerator. The spring loaded closer will pull the door from the full open to the full closed position. The closure includes a cushioning arrangement to eliminate any vibrations of the latching mechanism when the door is moved to the fully open position.

One of the primary features of the invention is the provision of a door closer apparatus which has a trim profile, easy to operate and little maintenance.

Another feature of the invention is the provision of a continuous bias force on the door from full open to full closed.

A further feature of the invention is the provision of cushions within the door closer to eliminate vibration and noise in the operation of the closer.

Another feature of the invention is the provision of a mechanical stop to limit the motion of the door so that the door is protected from damage due to obstructions located in close proximity to the door.

Other principal features and advantages of the invention will become apparent to those skilled in the art upon review of the following detailed description, claims and drawings.

DETAILED DESCRIPTION OF THE DRAWINGS

FIG. 1 is a perspective view of a refrigerator showing the location of the door closer according to the present invention.

FIG. 5 is an exploded perspective view of the closer apparatus.

Figure 2:
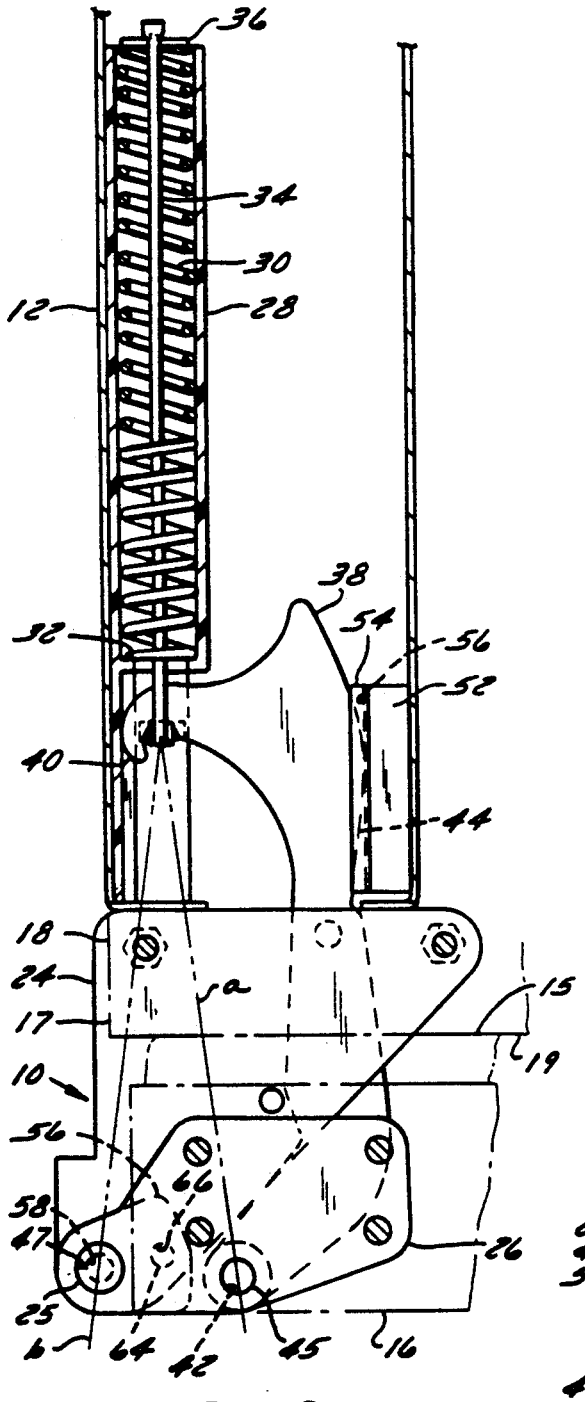
FIG. 2 is a view of the door closing apparatus in the fully closed position.

Although only one embodiment of the invention is explained in detail, it is to be understood that the invention is not limited in its application to the details of construction and the arrangement of components set forth in the following description or illustrated in the drawings. The invention is capable of other embodiments and being practiced and carried out in various ways. Also it is to be understood that the phraseology and terminology used herein is for the purpose of description and should not be regarded as limiting.

DETAILED DESCRIPTION OF THE PREFERRED EMBODIMENTS

Figure 3:
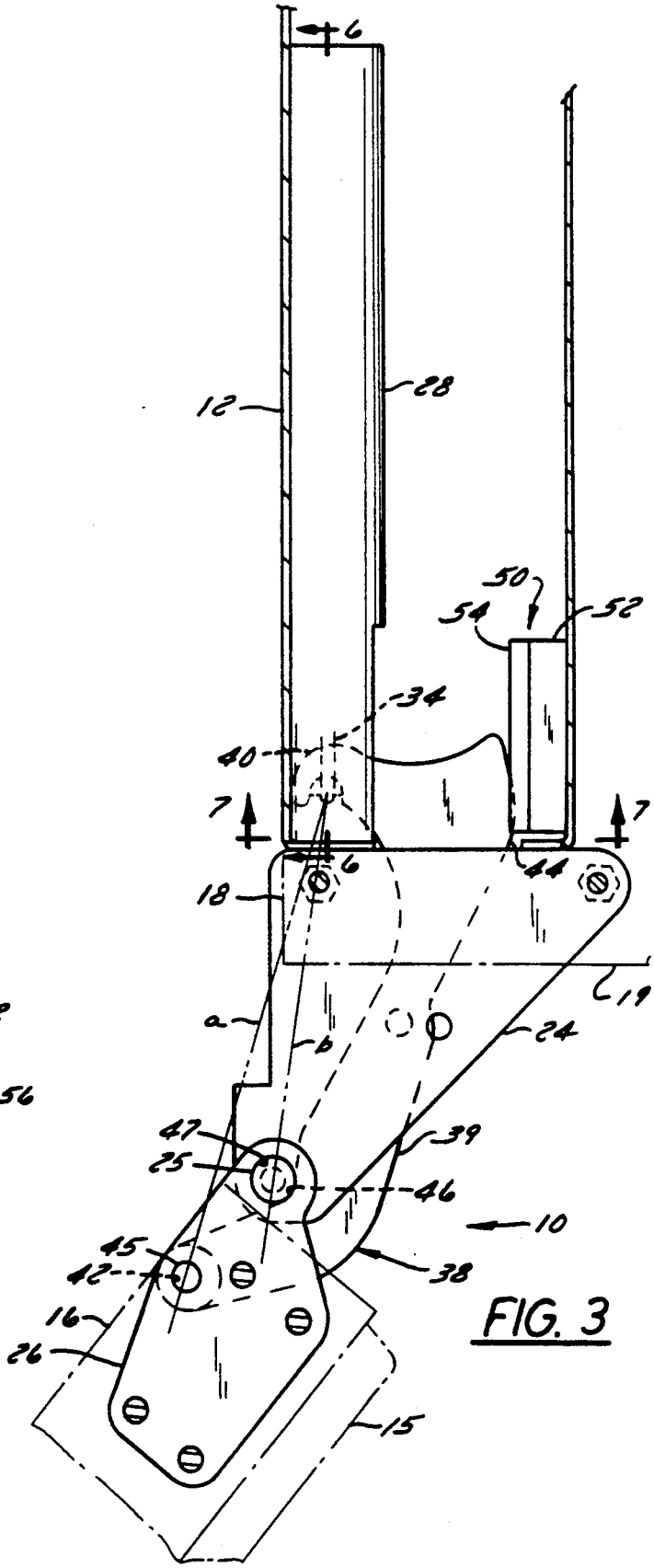
FIG. 3 is a view of the door closing apparatus in the fully open position.

The door closer assembly 10, as seen in the drawings, is shown mounted in the front of a leveler housing 12 mounted on the bottom of a refrigerator 14 which includes a cabinet 18 and a door 16. The cabinet 18 includes a door frame 17 having a front facing surface 19. The door 16 has a confronting surface 15 which overlaps the front facing surface 19. The door 16 is supported on the cabinet 18 by means of upper and lower hinge assemblies 20 and 22 which define a pivot axis 21 which is spaced outwardly from the front facing surface 19. The lower hinge assembly 22, as shown in FIGS. 3 and 5, includes a cabinet hinge plate 24 which is secured to the bottom of the refrigerator cabinet 18 and a door plate 26 which is secured to the bottom of the door 16. The door plate includes a pivot post 45 and an aperture 47. The door plate 26 is connected to pivot about the hinge plate 24 by aligning aperture 47 with a door pin 25 provided on plate 24. In accordance with the invention, the door closer assembly 10 is connected to the cabinet 18 and to the door plate 26 to provide a continuous closing bias force on the door from full open to full close.

In this regard, the door closer assembly 10 generally includes a spring housing 28 mounted on the inside of the leveler housing 12. A compression spring 30 is positioned in the housing 28 and is seated on a shoulder 32 provided on the inside of the housing 28. The spring 30 is retained in the housing 28 by means of a U-shaped linkage 34 having a spring retainer 36 mounted on the end thereof. The linkage 34 is connected to the door plate 26 by means of a door closer arm 38.

In this regard, the arm 38 includes a hook 40 at one end and an aperture 42 at the other end. The body portion 39 of the arm 38 is offset from a line passing through the axis of hook 40 and the axis of aperture 42 to provide clearance for the pivot pin 25 when the arm is moved between the open and closed positions of the door. The back of the body portion 39 of the arm is provided with a curved surface 44 and the front of the body portion 39 is provided with a notch 46.

Referring to FIGS. 2 and 3 it will be noted that the arm 38 is connected to the linkage 34 by means of the hook 40 and to the door plate 26 by means of a pivot pin 45 seated in aperture 47 in the doorplate 26. When the door is in the fully closed position as seen in FIG. 2, the spring 30 should be slightly compressed in order to provide a closing bias force on the door. As the door is opened to the fully open position as shown in FIG. 3, the motion of the pin 45 will pull the arm 38 toward the front of the refrigerator compressing the spring 30 as the pin 45 is moved to a position outwardly of the hinge pin 25. It should be noted that motion of the arm 38 is stopped when the notch 46 in the arm engages the pivot pin 25.

Means are provided for absorbing the shock in the arm 38 on engaging the pivot pin 25. Such means is in the form of a bumper assembly 50 provided on the inside of the leveler housing 12. The bumper assembly includes an elastomeric bumper block 52 and a guide 54 which is mounted on the surface of the bumper block 52. The guide 54 includes a groove 56 which is positioned in the path of motion of the curved surface 44 of the arm 38. When the arm engages the pivot pin 25, the curved surface 44 will be pivoted into engagement with the bumper which absorbs the force of the pivot motion of the arm when it engages the pivot pin 25.

Figure 4:
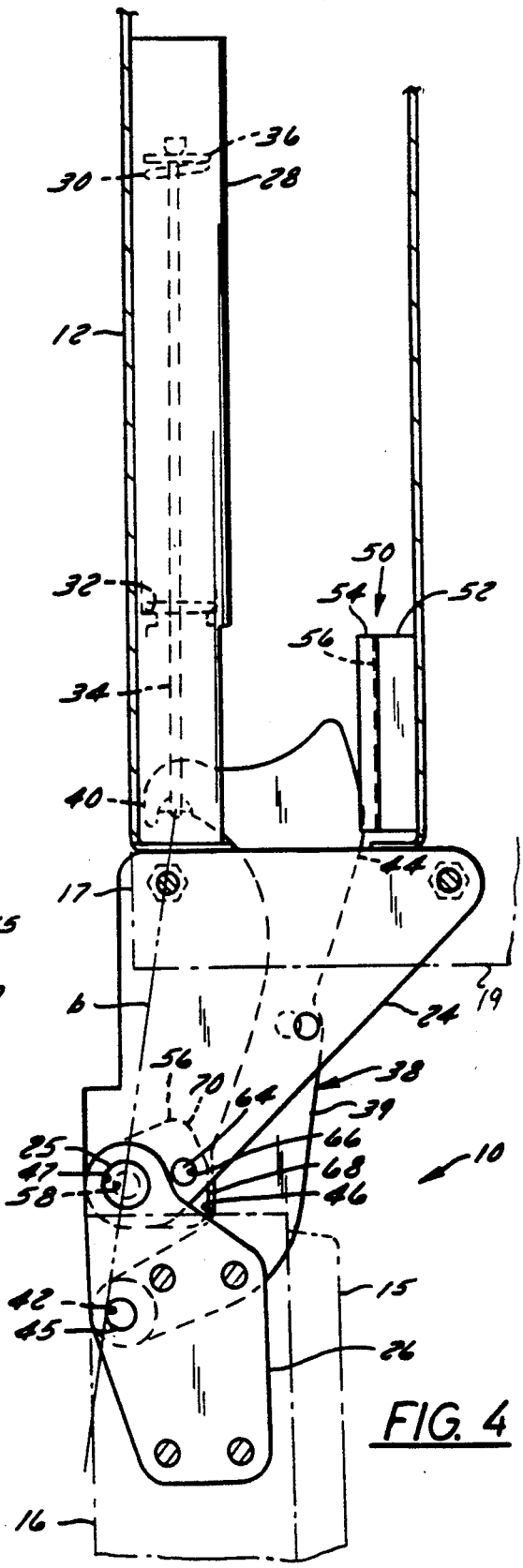
FIG. 4 is a view of the mechanical stop for limiting the door to the open position of the door.
Figure 6:
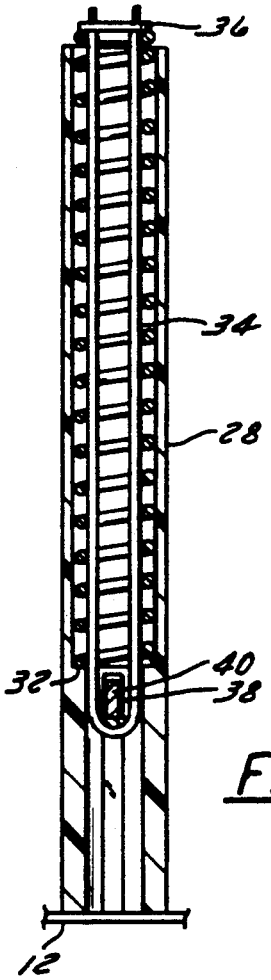
FIG. 6 is a view taken on line 6—6 of FIG. 3 showing the door closure spring housing.
Figure 7:
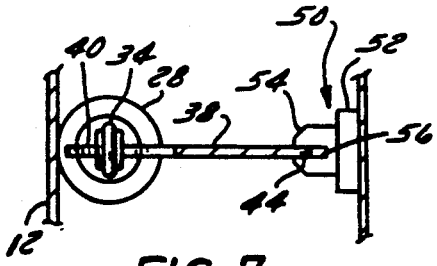
FIG. 7 is a view taken on line 7—7 on the door closure link seated in the door closure link guide.

Means can be provided for stopping the door at intermediate points between fully open and fully closed to prevent the door from bumping obstructions such as a counter or wall located in close proximity to the refrigerator door. Such means is in the form of a door stop 56 as shown in FIGS. 1 and 4. The door stop 56 includes an opening 58 which engages the hinge pin 25. The door stop 56 is retained thereon by means of a clip 60 which is mounted on a slot 62 in pin 25. Means are provided on the stop 56 for positively locating the position of the stop 56 with respect to the pin 25. Such means is in the form of a stop pin 64 which is positioned to engage an opening 66 in the hinge plate 24.

The stop 56 is provided with a first 90 degree curved surface 68 and a second 87 degree surface 70. As seen in FIG. 4, when the door is opened, the notch 46 in the arm 38 will engage the curved surface 68 on the stop 56. The door will then be located at a 90 degree angle with respect to the front surface of the refrigerator. It should be noted that in this position the door cannot be opened against any obstruction which may be located next to the refrigerator. If the stop is turned over and the stop pin 64 aligned with the hole 66 in the hingeplate, the curved surface 70 will then be positioned to engage the notch 46 in the arm 38. In this position the door will be opened to a 93 degree angle with respect to the front of the refrigerator.

In each of the positions of the door a continuous closing force will be exerted on the door by the spring 30 through the arm 38. However, this force will be minimized due to the relation of the pin 44 with respect to the hook 40. When the pin 45 is aligned with a line b which passes through the axis of the hinge pin 25 and the hook 40 the closing force on the door will be at a minimum due to the offset relation of the end of the arm 38 as the door is closed the moment arm between the axis of the hinge pin 25 and the pin 44 will increase, thus increasing the closing force on the door to assure positive latching of the door when it is fully closed.

Thus, it is apparent that there has been provided, in accordance with the invention, a door closer that fully satisfies the aims and advantages set forth above. While the invention has been described in conjunction with specific embodiments thereof, it is evident that many alternatives, modifications, and variations will be apparent to those skilled in the art. Accordingly, it is intended to embrace all such alterantives, modifications and variations as fall within the spirit and broad scope of the appended claims.

I claim:

1. A household refrigerator of the type having a door frame with a front faced surface and a door having a confronting surface overlapping the front faced surface, and door closer assembly for supporting the door for pivotal movement between open and closed positions with respect to the front faced surface, said assembly comprising:

a planar hinge plate mounted on the frame;

a pivot pin mounted on said hinge plate in a spaced relation to the front faced surface;

a planar door plate mounted on the door and having an aperture spaced from the confronting surface of the door, said door plate being mounted on said hinge plate with said pivot pin aligned in said aperture;

a pivot post mounted on said door plate in a spaced relation to said aperture; and an arm having an aperture at one end thereof directly connected to said pivot post and means mounted on the refrigerator for biasing said arm in a door closing direction.

2. The door closer assembly according to claim 1 wherein said biasing means comprises:

a housing mounted on the refrigerator;

a compression spring mounted in said housing;

a linkage connecting said arm to said spring, said linkage comprising:

a U-shaped link extending through said compression spring; and a spring retainer mounted on the end of said link for holding the spring in a compressed condition.

3. The door closer assembly according to claim 2 including a resilient bumper mounted in the housing in a position to engage said arm and a guide mounted on said bumper for guiding the movement of the arm past the bumper.

4. The door closer assembly according to claim 1 wherein said biasing means includes a compression spring mounted in a housing which is mounted on the refrigerator; and a connecting link, and means for connecting said link to said arm, said pivot post being located in a position to move outwardly around the pivot pin whereby the bias force of said compression spring increases as the door is opened.

5. The door closer assembly according to claim 4 wherein said arm includes a hook at the other end having a pivot axis and being operably connected to said compression spring, said aperture at said one end operably connected to pivot about the axis of said pivot post, and a center portion offset from a line connecting said hook axis and said pivot post axis to allow said arm to rotate past the pivot pin.

6. The door closer according to claim 5 including stop means mounted on said pivot pin for selectively limiting the pivotal motion of the door to intermediate points between fully opened and fully closed.

7. A door closer assembly for supporting a door for movement into engagement with the front face surface of the frame of a refrigerator, said assembly comprising:

a first planar hinge plate mounted on said frame;

a pivot pin mounted on said plate in a spaced relation to the front face surface of the frame;

a second planar hinge plate mounted on the door, said second hinge plate having an aperture spaced from the side of the door for engagement with said pivot pin whereby the door is pivotable between opened and closed positions with respect to said frame;

a post mounted on said second hinge plate for pivotal movement about said pivot pin; and a pivot arm having an aperture at one end thereof directly connected to said post and means including said pivot arm for biasing the door to a closed position with respect to the frame, said pivot arm having an offset body portion to provide clearance for said pivot pin when the door is opened and closed.

* * * * *